United States Patent [19]

Fox

[11] Patent Number: 4,951,552

[45] Date of Patent: Aug. 28, 1990

[54] LOCKING CYLINDER

[76] Inventor: Anton F. Fox, 2542 Wharton Glen Avenue, Mississauga, Ontario, Canada, L4X 2A9

[21] Appl. No.: 441,872

[22] Filed: Nov. 27, 1989

[51] Int. Cl.[5] ..... F15B 15/26

[52] U.S. Cl. ..... 92/27; 91/45; 92/24

[58] Field of Search ..... 92/23, 24, 27, 28; 91/45

[56] References Cited

U.S. PATENT DOCUMENTS

| | | | |
|---|---|---|---|
| 2,713,328 | 7/1955 | Driskel et al. | 92/24 |
| 3,115,330 | 12/1963 | Dollison | 92/24 |
| 4,635,536 | 1/1987 | Liu et al. | 92/24 |
| 4,742,758 | 5/1988 | Della Rocca | 92/24 |

*Primary Examiner*—Allen M. Ostrager

*Attorney, Agent, or Firm*—Jeffers, Hoffman & Niewyk

[57] ABSTRACT

A hydraulic actuator including an actuator cylinder and a ram slidable therein from a retracted position to an extended position. This ram has an axially extending chamber positioned in an end section and a number of ball passageways extend between this chamber and the outer surface of the ram. A locking ball is positioned in each passageway. A ring is slidably mounted on the ram and is positioned at its forwardmost point of travel to hold the balls so that they do not project from the passageways. A spring biases the ring towards its forwardmost position. A ball moving spool is slidably mounted in the chamber and has an annular ball receiving recess. A stop is located in an end section of the cylinder for preventing further forward movement of the ring and this stop causes the ring to slide rearwardly relative to the ram upon further extension of the latter.

20 Claims, 6 Drawing Sheets

LOCKING CYLINDER

This invention relates to fluid pressure actuators and more particularly to such actuators that include a locking mechanism for holding the ram in an extended position.

There are many operating situations where a fluid or hydraulic actuator is required to assume an operating position in which it is subjected to a substantial external loading. In such cases, when the loaded position is assumed by the actuator, it is advantageous to provide a mechanical locking mechanism that will physically restrain the ram from movement from this operating position.

Various constructions are known for physically interlocking the ram of a hydraulic actuator in a certain desired position. One such actuator is shown and described in U.S. Pat. No. 4,712,471 issued Dec. 15, 1987 to Ex-Cell-O Corporation. This actuator has a locking mechanism engageable with the main ram to hold it in a fully retracted position. The locking mechanism includes three locking jaws that move in a radial direction. Each jaw engages a groove cut into a rod adjacent the piston head of the main ram. The jaws are cammed into a locking position by a conical sleeve actuated by hydraulic pressure. The cylinder has an actuator head secured at one end by suitable screws. The opposite end is formed as a small diameter extension provided with grooves for mounting annular seals. Fluid pressure is supplied to opposite ends of the piston head through tubes.

U.S. Pat. No. 4,586,125 issued May 6, 1986 to General Dynamics Pomona Division, describes various versions of a clamp locking device. In one embodiment (FIG. 2 of the Patent) there is a piston rod connected to a primary piston and a cylinder in which the piston can slide. The cylinder is provided with an annular indentation to receive locking balls which are mounted in radial holes in the piston. A secondary piston is mounted inside the primary piston and it has indentations or recesses located to mate with the holes in the piston during operation of the device. The normal position of the secondary piston, due to the pressure of a spring acting thereon, is a closed position, that is a position where the balls are forced into the annular indentation in the cylinder.

It is an object of the present invention to provide a reliable hydraulic actuator that can be locked in the extended position and that has relatively few parts. It is a further object of the invention to provide a novel locking actuator which Can be used in a variety of applications including uses in aircraft and railway cars and which employs locking balls which are located in ball passageways formed in the ram. A special ring slidable on the ram controls the operation of these locking balls.

SUMMARY OF THE INVENTION

According to one aspect of the invention, there is provided a hydraulic actuator comprising an actuator cylinder with an actuator head closing one end of said cylinder and a longitudinal passageway and ram slidable in this passageway from a retracted position to an extended position. The ram has an axially extending chamber positioned in an end section of the ram located closest to the actuator head. A number of openings forming ball passageways extend between this chamber and an outer, circumferential surface of the ram. A number of locking balls are positioned in these openings and a ring is slidably mounted on the ram so that at its forwardmost point of travel it is positioned to hold the balls so that they do not project from the openings. A biasing device such as a spring tends to move the ring away from the actuator head to its forwardmost point of travel. A spool is slidably mounted in the chamber and has a first ball receiving recess arranged about its circumferential periphery. At least a portion of the locking balls are located in this recess during extension of the ram. A stop is located in an end section of the cylinder opposite the actuator head for preventing further forward movement of the ring when the latter reaches the stop. This stop causes the ring to slide rearwardly relative to the ram upon further extension thereof. A second ball receiving recess is located in the end section of the cylinder opposite the actuator head. First means are provided for sliding the spool in a forwards direction in the chamber and thereby causing the locking balls to move radially outwardly to a position where they project into the second recess. This first sliding means moves the spool when the ring is slid rearwardly by the stop. Second means are provided for sliding the spool in a rearwards direction in the chamber and for causing the locking balls to move radially inwardly in order to permit retraction of the ram into the cylinder by pressurized hydraulic fluid.

According to another aspect of the invention, a locking hydraulic actuator has hydraulic fluid passageways in the cylinder and the ram for causing pressurized hydraulic fluid to flow to and from the aforementioned chamber in the ram. In this way a ball moving device is operated by the flow of the hydraulic fluid and in one position of the device, the locking balls project into the ball receiver or recess located near the forward end of the cylinder in order to lock the ram in its extended position.

Preferably, the ram includes both a cylindrical piston member and a ram shaft threadedly connected to the piston member. The piston member has an external diameter substantially equal to the diameter of at least a major section of the longitudinal passageway in the cylinder.

Further features and advantages of the present hydraulic actuator will be apparent from the following detailed description taken in conjunction with the accompanying drawings.

DETAILED DESCRIPTION OF PREFERRED EMBODIMENT

Figure 1:
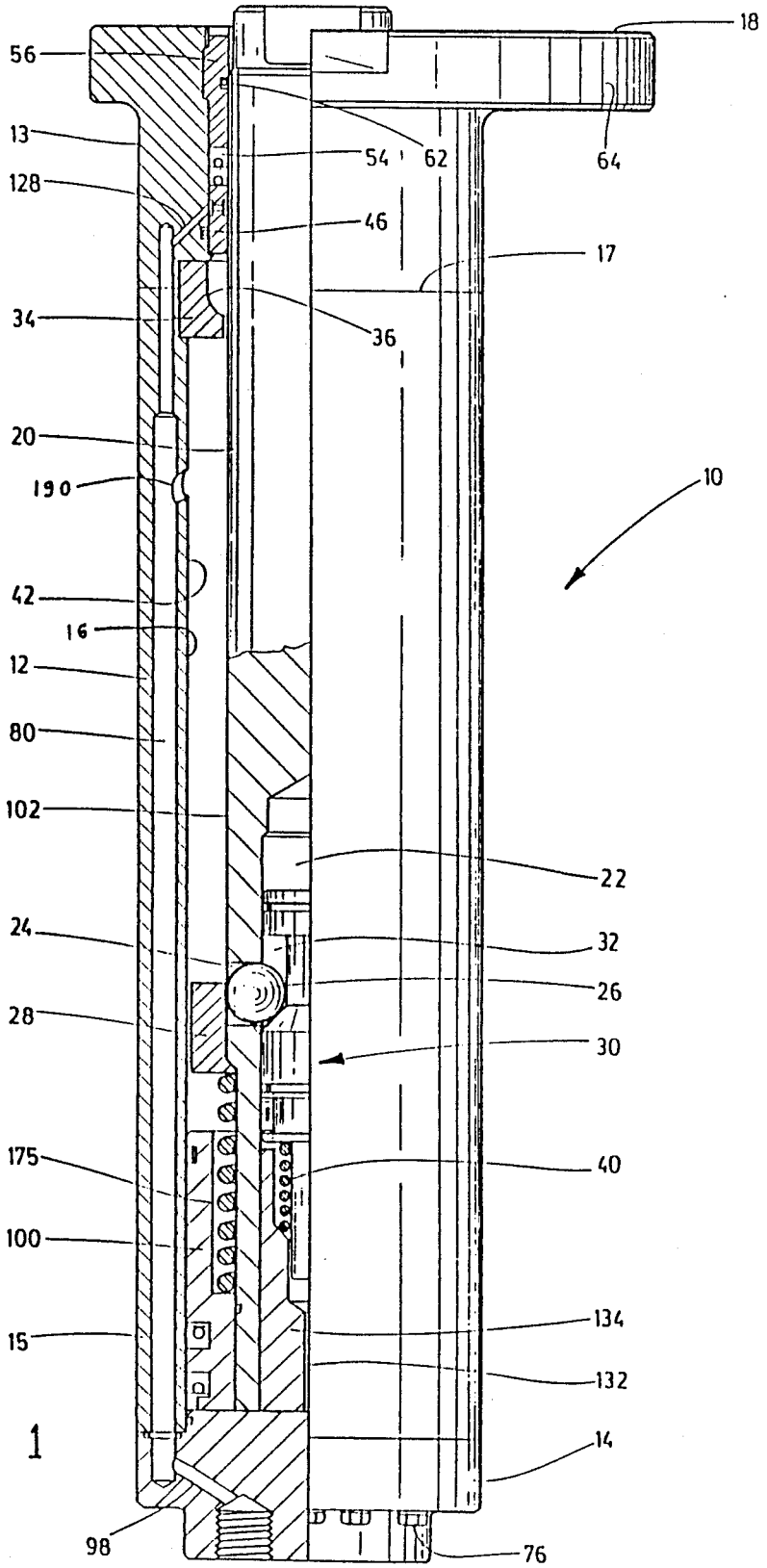
FIG. 1 is a side view, partly in axial cross-section, of a locking hydraulic actuator constructed in accordance with the invention, said actuator being shown in the retracted position.
Figure 2:
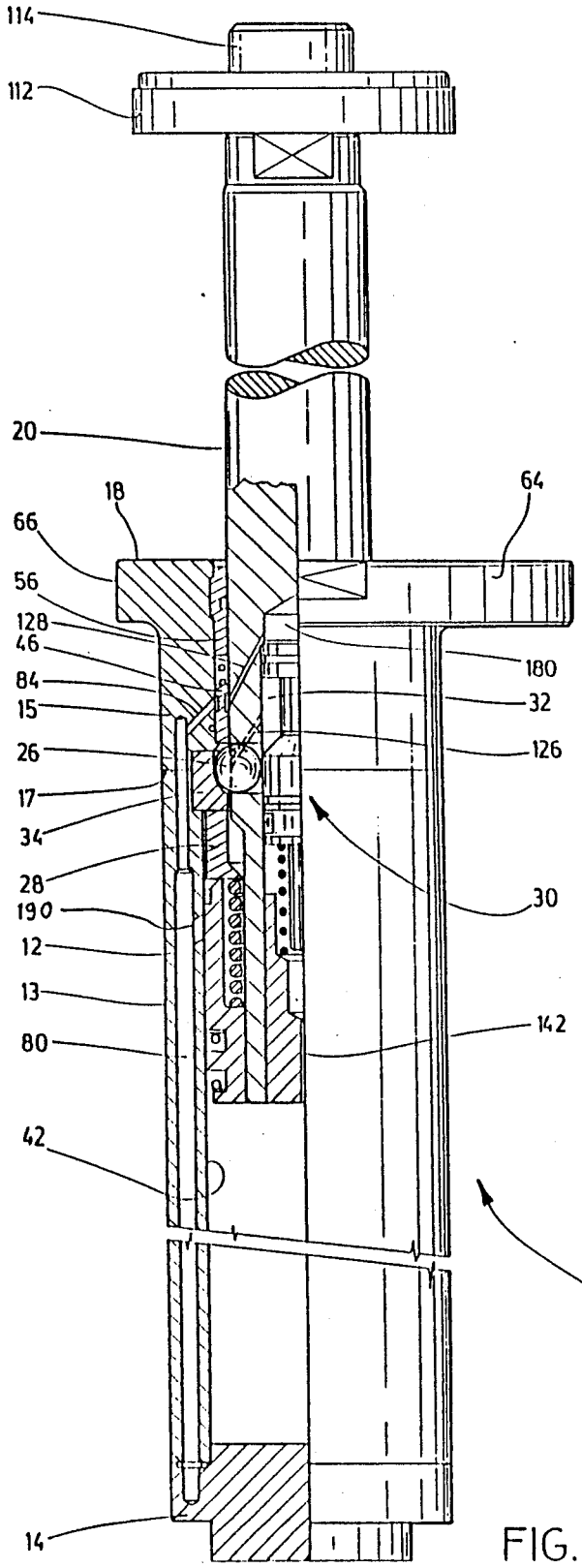
FIG. 2 is a side view, partly in axial cross-section of a hydraulic actuator of FIG. 1, which view shows the ram in the extended position thereof.
Figure 3:
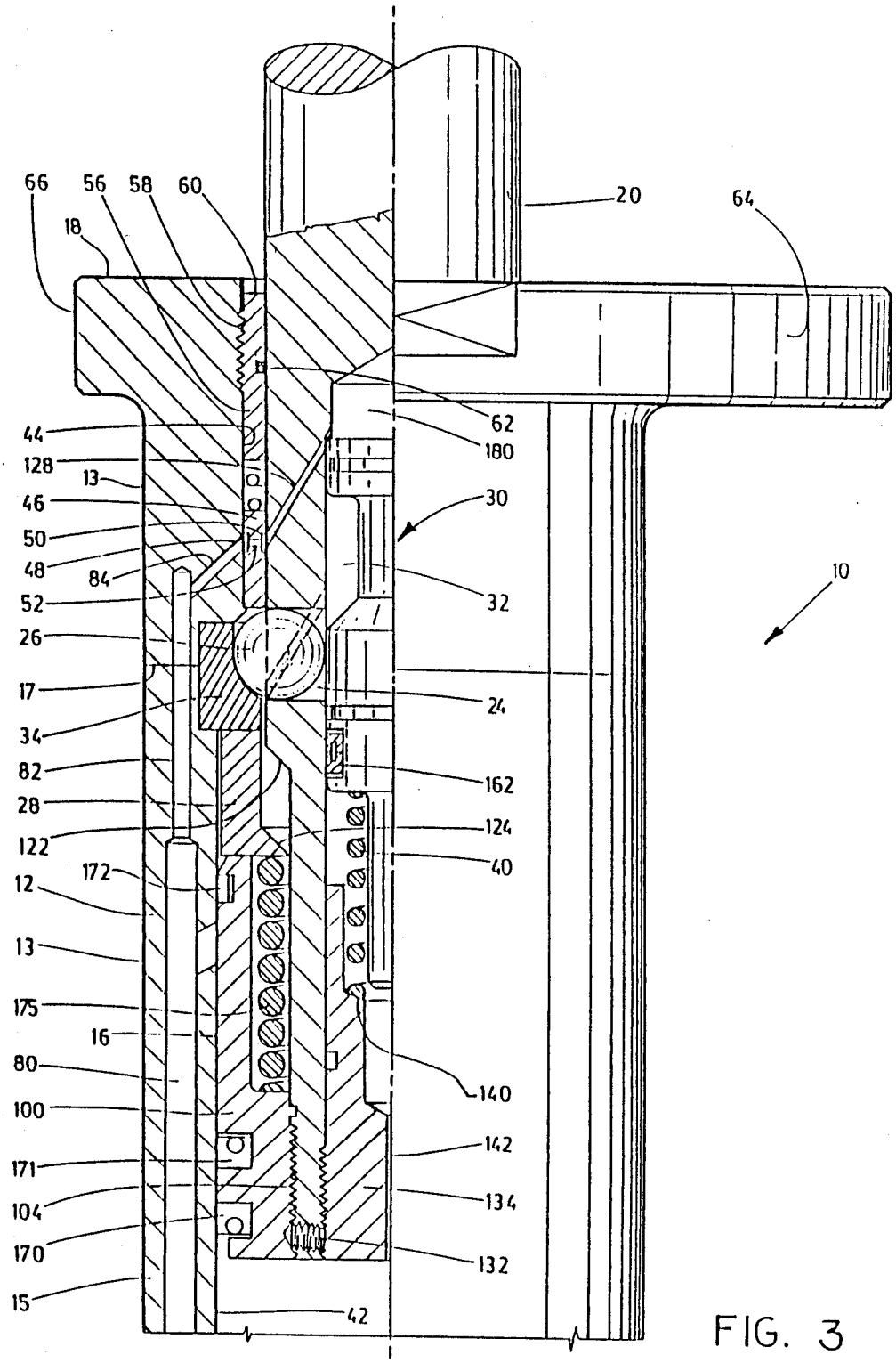
FIG. 3 is a side view, partly in section and on a larger scale, showing the forward end of the cylinder and part of the ram in the extended position of the actuator.

Reference will first be made to FIGS. 1 to 3 in order to briefly describe the main components of a preferred hydraulic actuator 10 constructed in accordance with the invention. This actuator includes an actuator cylinder 12 with an actuator head 11 detachably mounted at the rear end thereof and closing off this end. The cylinder has a longitudinal passageway 16 extending from the actuator head to the front end 18 of the cylinder. A hydraulic ram 20 is slidable in this passageway from a retracted position shown in FIG. 1 to an extended position shown in FIGS. 2 and 3. The ram has an axially extending chamber 22 positioned in an end section of the ram located closest to the actuator head. A number of openings 24 forming ball passageways extend between the chamber and an outer circumferential surface of the ram. A number of locking balls 26 are positioned in these openings and these are used to lock the ram in its extended position. A hardened steel ring 28 is slidably mounted on the ram. At its forwardmost point of travel relative to the ram (shown in FIG. 1) the ring holds the balls 26 so that they do not project from the openings 24. A spool 30 is slidably mounted in the chamber 22. The spool has a ball receiving recess 32 arranged about its circumferential periphery. As shown in FIG. 1, a portion of the locking balls are located in this recess when the ram is retracted and also when it is being extended.

A stop member in the form of a hardened steel cup 34 is located in an end section of the cylinder opposite the actuator head for preventing further forward movement of the ring 28 when the latter reaches this stop and for causing the ring to slide rearwardly relative to the ram upon further extension of the ram. A second ball receiving recess 36 is formed in the stop member 34. The stop member 34 is installed in the cylinder 12 by forming the latter from two separate components 13 and 15 that are press welded together at 17 after the member 34 is inserted in recesses provided for it. The combined unit forming the cylinder 12 is then drilled as required. A first sliding means is provided to move the spool 30 in a forwards direction in the chamber, thereby causing the balls 26 to move radially outwardly to the position where they project into the second recess 36. This first sliding means which includes a coil spring 40, moves the spool 30 when the ring 28 is slid rearwardly by the stop member 34. There are also second means for sliding the spool 30 in a rearwards direction in the chamber 22 when the ram is in the extended locked position. This second means causes the locking balls to move radially inwardly in order to permit retraction of the ram into the cylinder by pressurized hydraulic fluid.

Turning now to the preferred details of the cylinder 12 and the actuator head, the cylinder has a relatively long portion 42 in which the longitudinal passageway has a uniform diameter. At the front end of portion 42 is a short section of maximum diameter wherein the stop member 34 is mounted. There is then a reduced diameter section 44 of the passageway which is at the forward end of the cylinder. Centrally mounted in this reduced diameter section is a brass ring 46 which is uniform about its circumference. This ring 46 has an annular outer recess 48 and an annular inner recess 50. There are also one or more short interconnecting passageways 52 to permit hydraulic fluid to flow from the outer recess 48 to the inner recess 50. Two U-cup seals 54 are mounted forwardly of the ring 46. In order to close the longitudinal passageway 16 there is a second brass ring 56 which is held by external threading 58 in the cylinder. In the preferred embodiment of the ring 56, four notches spaced uniformly about the circumference of the ring are formed in its outer surface 60 so that a suitable tool can be used to remove the ring 56 when desired. Also an annular internal groove 62 is preferably formed in the ring 56 to accommodate an O-ring seal.

Formed on the forward end of the cylinder is a large connecting flange 64 which is generally circular except for a flat side 66. The front of the flange 64 can be seen clearly in FIG. 6. In this embodiment, the flange is formed with two large bolt receiving holes 68 surrounded on one side by U-shaped recesses 70 which accommodate the head of the bolt (not shown). The shape and construction of the connecting flange 64 can of course vary widely depending upon the particular use to which the actuator 10 is to be put.

Figure 4:
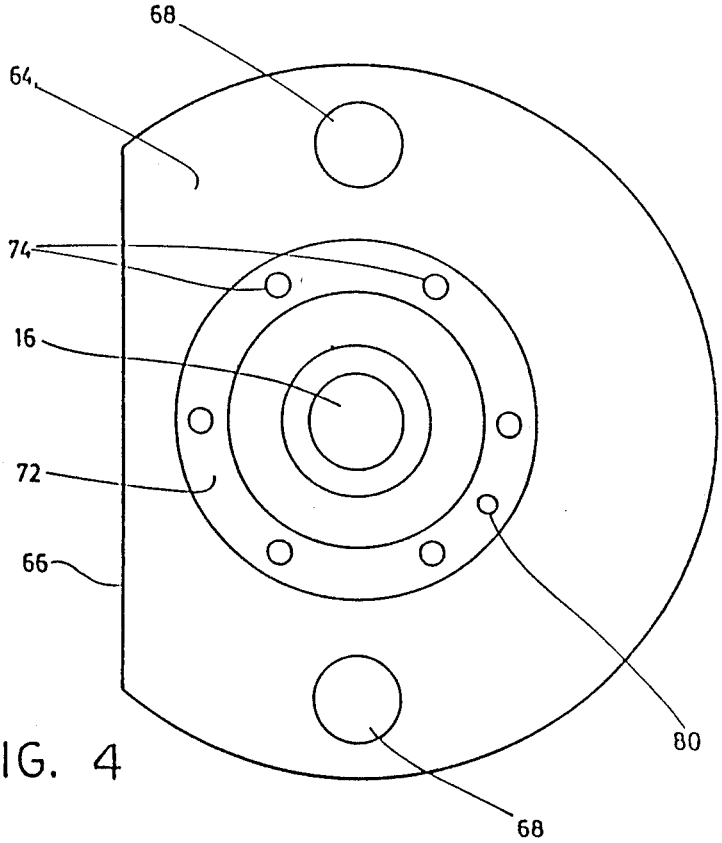
FIG. 4 is an end view of the cylinder.

The configuration of the rear end of the cylinder can be seen in FIG. 4. There is an annular rear surface 72 to which the actuator head 14 is connected. Formed in the rear surface are six evenly spaced, threaded holes 74. Six bolts 76 (see FIG. 5) extend through holes in the actuator head and are threaded into the holes 74. Also shown in FIG. 4 is the end of a first hydraulic fluid passageway 80 through which hydraulic fluid under pressure is pumped in order to unlock the actuator. The passageway 80 has a reduced diameter end section 82 located in the vicinity of the stop member 34 and an inwardly sloping section 84 which opens into the aforementioned annular recess 48.

Figure 5:
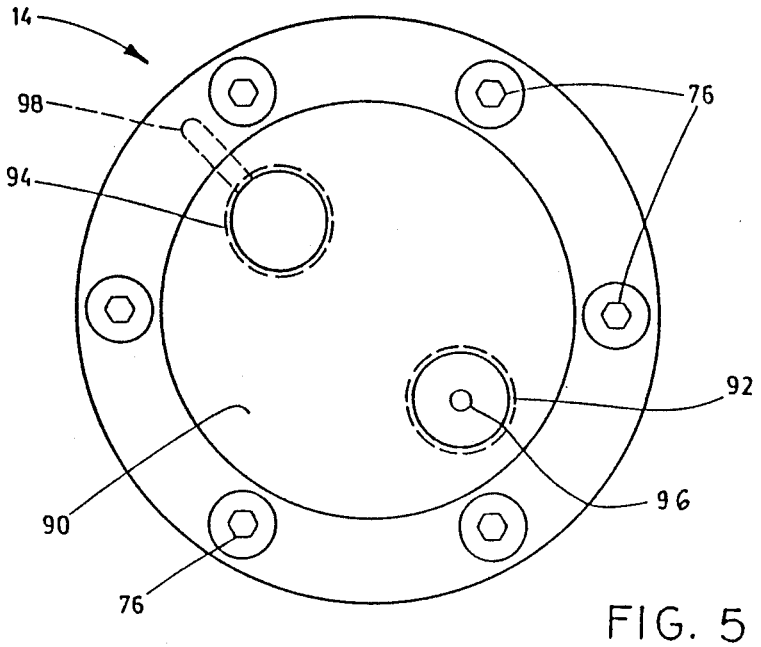
FIG. 5 is an end view of the end plate or actuator head that covers the rear end of the cylinder.

The outer end of the actuator head 14 can be seen in FIG. 5. The head is formed with a round protrusion 90. Formed in the protrusion 90 are two threaded holes 92 and 94 to which hydraulic lines (not shown) can be attached in order to deliver pressurized hydraulic fluid to the actuator and to permit escape of this fluid when required.

The hole 92 leads to a smaller hole 96 that extends right through the actuator head and into the longitudinal passageway 16. Pressurized hydraulic fluid is pumped through the hole 96 in order to extend the ram. On the other hand the hole 94 does not extend into the passageway 16. Instead there is an angled passageway 98 that leads from the hole 94 and opens into the aforementioned hydraulic fluid passageway 80. Accordingly, pressurized hydraulic fluid pumped through the hole 94 will go through the passageway 80 and eventually into the annular recess 50 where it can flow into the chamber 22 as explained further hereinafter.

Figure 8:
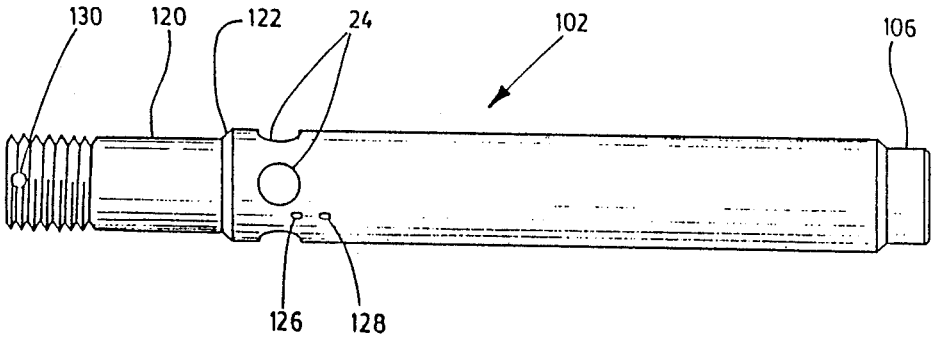
FIG. 8 is a side view of the shaft portion of the ram.

The ram 20 includes as its major components a cylindrical piston member 100 and a ram shaft 102, which is shown separately in FIG. 8. The piston member is threadedly connected to the inner end of the ram shaft by threads located at 104. It is the ram shaft 102 that has the aforementioned openings 24 formed therein.

Figure 6:
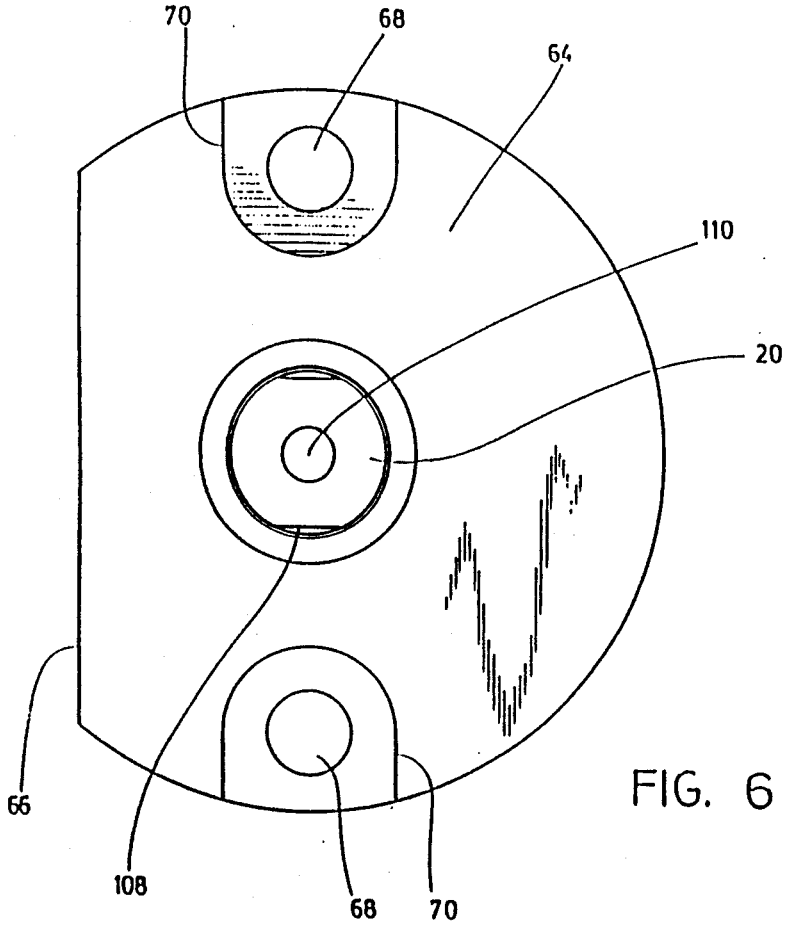
FIG. 6 is a front view of the hydraulic actuator.
Figure 7:
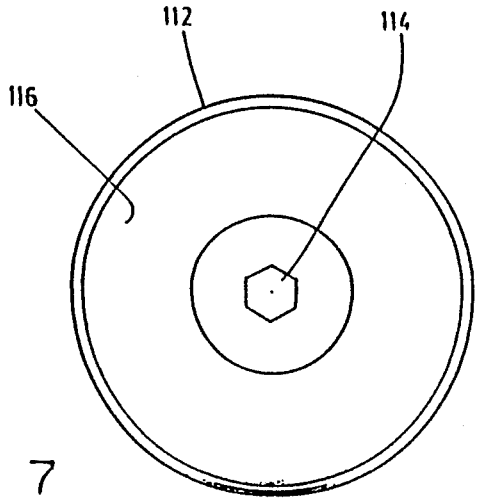
FIG. 7 is an end view of the wide end of the ram that is located outside the cylinder.

Referring now to the details shown in FIG. 8, the ram shaft has a reduced diameter, short end section 106. This end section has flats 108 on opposite sides thereof as indicated in FIG. 6. In this end of the ram shaft, there is a threaded bolt hole 110 to permit attachment of a circular steel cushion 112 using a bolt 114 shown in FIG. 7. The circular steel plate that forms the cushion 112 has a plastic coating 116 in this particular embodiment. An inner section 120 of the ram shaft has a reduced diameter. A shoulder 122 is formed on the shaft where this inner section meets the remainder of the shaft. This shoulder 122 forms a stop to prevent further forward movement of the ring 28 as indicated in FIG. 1. The ring 28 has a radially inwardly projecting lip 124 adapted to engage the shoulder and located at the inner end of the ring. A further feature of the ram shaft is the provision of two, small sloping passageways 126 and 128 located near one of the openings 24 as shown in FIG. 8. The function of these two fluid passageways will be described further hereinafter. Also the inner end of the ram shaft has a small opening 130 in order to receive a set screw indicated at 132 in FIG. 3. The set screw 132 secures the piston member on the ram shaft and prevents relative rotation.

The aforementioned chamber 22 is substantially closed at its inner end by a cylindrical member 134 which is partially threaded on its outer surface so that it can be connected by these threads to the cylindrical opening formed in the end of the ram shaft. It will be understood that the spool 30 is inserted into the ram shaft together with the spring 40 prior to insertion of the cylindrical member 134. The axial opening in the member 134 has a reduced diameter section in order to form a forwardly facing shoulder 140. One end of the spring 40 engages the shoulder 140 while the other end of the spring engages a rearwardly facing shoulder formed on the spool. A hydraulic fluid passageway 142 extends from the inner end of the ram shaft through the member 134 and to the inner end of the chamber. In this way not only does the spring 40 act to bias the spool in the forwards direction, but also pressurized hydraulic fluid which is being used to extend the ram also acts to push the spool in a forwards direction. Of course this forward movement is prevented as long as the ring 28 remains in the position shown in FIG. 1.

Figure 9:
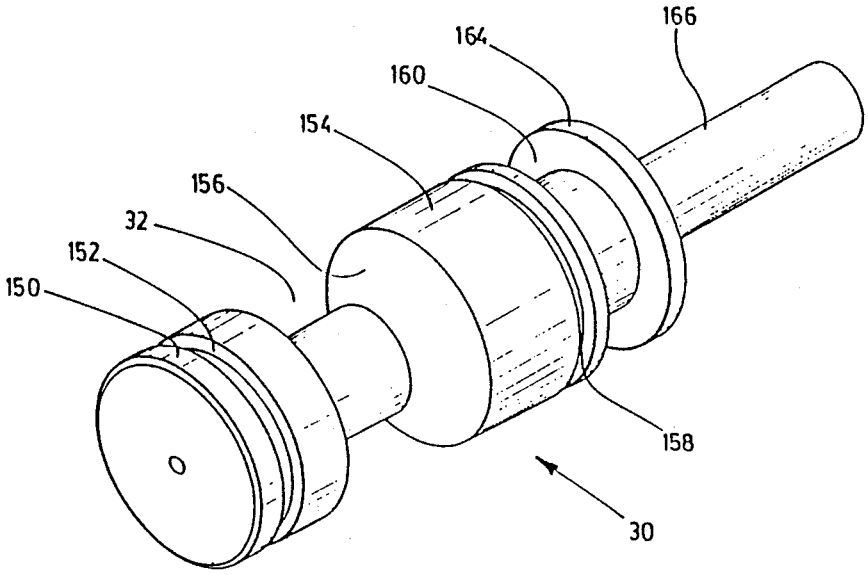
FIG. 9 is a perspective view of the spool mounted in the ram shaft of FIG. 8.

Reference will now be made to FIG. 9 which illustrates the details of the spool 30. This spool has a ball receiving recess 32 that extends about the circumference of the spool. There is a forward section 150 having a diameter substantially equal to the internal diameter of the chamber. Formed in the section 150 is an annular groove 152 into which a suitable seal, such as an O-ring, is mounted. There is a large intermediate section 154 located just to the rear of the recess 32 and this section forms a sloping surface 156 that forms a side of the recess 32. Section 154 also has an annular groove 158 which receives a suitable seal, such as an O-ring. Immediately to the rear of the section 154 is another annular recess 160 which is not as deep as the recess 32 and has front and rear sides that extend generally perpendicular to the centre axis of the spool. Mounted in this recess 160 is a large U-cup seal 162 shown in FIGS. 1 and 2. Immediately to the rear of the recess 160 is a radially extending flange 164, the rear face of which is engaged by the aforementioned spring 40. There is also an end section 166 of relatively small diameter around which the coil spring 40 extends.

The piston member 100 is formed with annular grooves in its outer surface to receive further U-cup seals 170, 171 which engage the inside surface of the cylinder. Near the forward end of the piston member there is a further seal 172 located in an annular groove. The piston member has an external diameter greater than the remainder of the ram and substantially equal to the diameter of the major section 42 of the passageway 16. A coil spring 175 which biases the ring away from the actuator head to its forwardmost point on the ram shaft is arranged in an annular cavity formed between the piston member and the ram shaft. This spring 175 engages the rear surface of the ring 28 and it causes the ring 28 to move with the ram until further forward movement of the ring 28 is prevented by the stop member 34. As shown in FIG. 2, further extension of the ram will then compress the coil spring 175, permitting rearward movement of the ring and outward movement of the locking balls. The locking balls are pushed outwardly by the forward movement of the spool 30 which is biased to move in the forwards direction.

The ram then becomes locked in the extended position by the balls as shown in FIGS. 2 and 3.

In order to retract the ram, hydraulic fluid under pressure is pumped through the aforementioned first passageway 80 and eventually into the inner recess 50 formed in brass ring 46. As shown in FIG. 2, the hydraulic fluid then flows through sloping passageway 128 into the forward end 180 of the chamber 22. This first causes the spool 30 to move rearwardly to a position where the balls can move back into the annular recess 32. Movement of the balls into this recess is assured by providing the second sloping passageway 126. Forward movement of the spool permits hydraulic fluid in the front end 180 of the chamber to flow through the passageway 126 and into the second recess 36, thereby forcing the locking balls to move radially inwardly. As soon as this occurs, the ram can begin to retract and the ring 28 will move forwardly to cover the ball openings. The ram will then retract on its own either due to forces acting on the steel cushion 112 or due to withdrawal of hydraulic fluid through the end hole 92 and pumping of hydraulic fluid through side opening 190 formed in the wall of the cylinder.

It will be clear to those skilled in the art of constructing hydraulic actuators that various modifications and changes could be made to the described actuator without departing from the spirit and scope of this invention. Accordingly all such modifications and changes as fall within the scope of the appended claims are intended to be part of this invention.

I therefore claim:

1. A hydraulic actuator comprising:

an actuator cylinder with an actuator head closing one end of said cylinder and a longitudinal passageway;

a ram slidable in said passageway from a retracted position to an extended position, said ram having an axially extending chamber positioned in an end section of the ram located closest to said actuator head and a number of openings forming ball passageways extending between said chamber and an outer, circumferential surface of said ram;

a number of locking balls positioned in said openings;

a ring slidably mounted on said ram and at its forwardmost point of travel positioned to hold said balls so that they do not project from said openings;

means for biasing said ring away from said actuator head to said forwardmost point of travel;

a spool slidably mounted in said chamber and having first ball receiving recess means arranged about its circumferential periphery, at least a portion of said locking balls being located in said recess means during extension of said ram;

stop means located in an end section of said cylinder opposite said actuator head for preventing further forward movement of said ring when the latter reaches said stop means and for causing said ring to slide rearwardly relative to said ram upon further extension of said ram;

second ball receiving recess means located in said end section of said cylinder opposite said actuator head;

first means for sliding said spool in a forwards direction in said chamber and thereby causing said locking balls to move radially outwardly to a position where they project into said second recess means, said sliding means moving said spool when said ring is slid rearwardly by said stop means; and second means for sliding said spool in a rearwards direction in said chamber and for causing said locking balls to move radially inwardly in order to permit retraction of said ram into said cylinder by pressurized hydraulic fluid.

2. A hydraulic actuator according to claim 1 wherein said biasing means comprises a coil spring extending around said end section.

3. A hydraulic actuator according to claim 1 wherein said first means for sliding said spool comprises a coil spring extending around one end of said spool, one end of said spring engaging a forwardly facing shoulder formed in said chamber and another end of said spring engaging a rearwardly facing surface of said spool.

4. A hydraulic actuator according to claim 1 wherein said ram includes a cylindrical piston member mounted at the inner end of said ram and having an external diameter greater than the remainder of the ram and substantially equal to the diameter of at least a major section of said longitudinal passageway.

5. A hydraulic actuator according to claim 1 wherein said second means for sliding said spool in a rearwards direction includes a first hydraulic fluid passageway extending through said actuator cylinder and opening into a reduced diameter section of said longitudinal passageway located at the end thereof furthest from said actuator head and a second hydraulic fluid passageway extending through one side of said ram and opening into a forward end portion of said chamber, said first and second passageways being connected to each other when said ram is fully extended.

6. A hydraulic actuator according to claim 1 including fluid sealing means mounted on said ram adjacent to the inner end thereof and a hydraulic fluid passage extending through said actuator head for delivering pressurized hydraulic fluid into said actuator cylinder at the inner end of said ram.

7. A hydraulic actuator according to claim 1 wherein said biasing means comprises a coil spring mounted on an end section of said ram and said ram includes a cylindrical piston member mounted at the inner end of a ram shaft and having an external diameter substantially equal to the diameter of a major section of said longitudinal passageway, said coil spring being arranged in an annular cavity formed between said piston member and said ram shaft.

8. A hydraulic actuator according to claim 7 wherein an inner end section of said ram shaft has a reduced diameter and a shoulder is formed on said shaft where said inner end section meets the remainder of the shaft, said shoulder forming a stop to prevent further forward movement of said ring on the ram, said ring having a radially inwardly projecting lip adapted to engage said shoulder.

9. A hydraulic actuator according to claim 8 wherein said first means for sliding said spool comprises a coil spring extending around one end of said spool and located in said chamber.

10. A hydraulic actuator according to claim 1 wherein said first means for sliding said spool includes a hydraulic fluid passageway extending from the inner end of said ram to the inner end of said chamber whereby pressurized hydraulic fluid acting to extend said ram also acts to push said spool in a forwards direction.

11. In a locking hydraulic actuator having an actuator cylinder with a longitudinal passageway therein and a ram slidable in said passageway from a retracted position to a locked extended position, an axially extending chamber located near the inner end of said ram, ball passageways extending from said chamber to an outer, circumferential surface of said ram, a locking ball positioned in each of said passageways, a ring slidably arranged on said ram and adapted to move from a rearward position where said ball passageways are not covered by said ring to a forward position where said ball passageways are at least partially covered by said ring, means for biasing said ring towards said forward position, ball moving means located in said chamber and movable from a first position where said locking balls project into said chamber to a second position where said balls are forced out of said chamber, stop means located near the forward end of said cylinder for preventing further forward movement of said ring where the latter reaches said stop means and for causing said ring to slide to said rearward position upon further extension of said ram, ball receiving recess means located near said forward end of said cylinder, and hydraulic fluid passageways in said cylinder and said ram for causing pressurized hydraulic fluid to flow to and from said chamber in order to operate said ball moving means, wherein the balls project into said ball receiving means in order to lock said ram in its extended position.

12. A hydraulic actuator according to claim 11 wherein said biasing means comprises a coil spring mounted in an end section of said ram.

13. A hydraulic actuator according to claim 12 wherein said ball moving means includes a spool and a coil spring extending around an end section of said spool, one end of said spring engaging an annular shoulder formed in the side of said chamber and the other end of said spring engaging a rearwardly facing surface of said spool.

14. A hydraulic actuator according to claim 11 wherein said ram includes a cylindrical piston member and a ram shaft threadedly connected to said piston member, which member has an external diameter substantially equal to the diameter of at least a major section of said longitudinal passageway.

15. A hydraulic actuator according to claim 11 wherein said hydraulic fluid passageways include a first passageway extending through said cylinder and opening into a reduced diameter section of said longitudinal passageway located at the forward end of said cylinder and a second passageway extending through one side of said ram and opening into a forward end portion of said chamber.

16. A hydraulic actuator according to claim 11 wherein said ram includes a cylindrical piston member and a ram shaft threadedly connected to said piston member, which member has an external diameter substantially equal to the diameter of at least a major section of said longitudinal passageway, sealing means are mounted in the cylindrical outer surface of said piston member, and said hydraulic fluid passageways include a primary passage at the rear end of said cylinder, which end is closed, for delivering pressurized hydraulic fluid into said longitudinal passageway at the inner end of said ram.

17. A hydraulic actuator according to claim 12 wherein said ram includes a cylindrical piston member and ram shaft threadedly connected to said piston member, which member has an external diameter substantially equal to the diameter of at least a major section of said longitudinal passageway, an inner end section of said ram shaft has a reduced diameter and a shoulder is formed where said inner end section meets the rest of the shaft, said shoulder forming a stop defining the forward position of said ring, and said ring has a radially inwardly projecting lip adapted to engage said shoulder.

18. A hydraulic actuator according to claim 17 wherein said coil spring is arranged in an annular cavity formed between said piston member and said inner end section of said ram shaft.

19. A hydraulic actuator according to claim 13 wherein said spool is formed with an annular recess having a sloping rear wall and said balls project into said recess in said first position of the ball moving means.

20. A hydraulic actuator according to claim 19 wherein said ram includes a cylindrical piston member and a ram shaft threadedly connected at one end to said piston member, and said hydraulic fluid passageways include a central axial passageway extending from the inner end of said ram to said chamber.

* * * * *